United States Patent [19]

Sedlak

[11] 4,200,542

[45] Apr. 29, 1980

[54] GREASE COMPOSITION

[75] Inventor: Michael Sedlak, Woodbury, N.J.

[73] Assignee: Mobil Oil Corporation, New York, N.Y.

[21] Appl. No.: 6,064

[22] Filed: Jan. 24, 1979

[51] Int. Cl.[2] ..... C10M 5/20; C10M 5/12; C10M 5/02; C10M 7/32

[52] U.S. Cl. ..... 252/25; 252/42.7; 252/50; 252/52 R; 252/400 R

[58] Field of Search ..... 252/25, 42.7, 50, 52 R, 252/400 R

[56] References Cited

U.S. PATENT DOCUMENTS

| | | | |
|---|---|---|---|
| 3,697,426 | 10/1972 | Lowe | 252/42.7 |
| 3,920,571 | 11/1975 | Crocker | 252/25 |
| 3,940,339 | 2/1976 | Clarke et al. | 252/25 |
| 4,115,284 | 9/1978 | Kinoshita et al. | 252/25 |

OTHER PUBLICATIONS

Chemical & Engineering News, 9/11/78, p. 18, "Article on Sodium Nitrite in Bacon".

*Primary Examiner*—Irving Vaughn
*Attorney, Agent, or Firm*—Charles A. Huggett; Raymond W. Barclay; Claude E. Setliff

[57] ABSTRACT

Grease compositions containing nitrites and amines form N-nitrosamines, which are suppressed by the addition to such compositions of a combination of metal ascorbate or metal isoascorbate with alpha tocopherol.

11 Claims, No Drawings

GREASE COMPOSITION

BACKGROUND OF THE INVENTION

1. Field of the Invention

The invention relates to grease compositions, and especially to such compositions containing inhibitors that suppress the formation of nitrosamines.

2. Discussion of the Prior Art

Grease compositions are generally used in environments where water, in minute or substantial quantity, is present. By way of illustration, grease compositions are required for military and naval use, as on the decks of navy and marine vessels, water pumps, mining machinery, steel and paper mills, food processing, and oil-well drilling operations. While the compositions provide lubricating value, they often fail to protect the metal parts with which they are in contact from rust formation. Required, then, are grease compositions that provide excellent lubrication in the presence of moisture and that inhibit rust formation.

Much progress has been made in fortifying grease compositions with rust inhibitors. Particularly effective in this regard is sodium nitrite. However, substantial concentrations of this salt are required to provide satisfactory inhibition and, with such concentrations, there may be a material loss of oxidation stability of the compositions. Therefore, many grease compositions also contain amines or products derived from amines as antioxidants. It is known that such a combination (i.e. nitrite plus amine) produces N-nitrosamines in lubrication environments. These have been found to be carcinogenic, and considerable effort has been put forth to discover combinations which do not produce nitrosamines. However, since the nitrites are among the most effective rust inhibitors for greases, many specifications have been built around these. Therefore, the continued use of nitrites is economically desirable, so the present inhibitor combination was developed to allow this.

Applicants know of no art teaching the use of the inhibitor combination of this invention in greases. However, the USDA has recommended that bacon containing sodium nitrite be inhibited against nitrosamine formation with a combination of sodium erythorbate (isoascorbate) and sodium ascorbate (see the Sept. 11, 1978 issue of Chemical and Engineering News, page 18).

SUMMARY OF THE INVENTION

In accordance with this invention, there is provided a lubricating grease formulation comprising a lubricating vehicle, thickener, sodium nitrite, an arylamine and an amount of a combination of (1) metal ascorbate or metal isoascorbate with (2) an alpha tocopherol sufficient to inhibit the formation of N-nitrosamines. "Metal" is one selected from Group IA or Group IIA of the Periodic Table. It is preferably a metal of Group IA, and more preferably, sodium.

DISCUSSION OF SPECIFIC EMBODIMENTS

The amines useful in this invention preferably include the arylamines. These will have the formula $$R—Ar—NH—Ar'$$

wherein R is a $C_1$ to $C_{10}$ hydrocarbyl group, preferably an alkyl group. Ar and Ar' are $C_6$ to $C_{14}$ aromatic groups, including phenyl and naphthyl. Illustrative arylamines are N-phenylnaphthylamines, diphenylamine, wherein each phenyl group contains a $C_1$ to $C_{10}$ hydrocarbyl group, and p,p'-dioctyldiphenylamine. Any of the amines disclosed herein may be used singly or in combination. They are used in the grease to the extent of from about 0.5 to about 3.0 percent by weight of the total formulation, preferably from about 1.0 to about 2.0 percent.

Sodium nitrite can be used in the grease formulation in concentrations of from about 0.5 to about 3.0 percent by weight of the formulation, preferably from about 1.0 to about 2.0 percent.

One of the useful inhibitors of the combination or mixture is the sodium salt of ascorbic acid, which salt has the formula

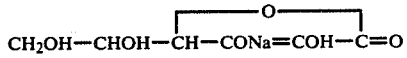

or the sodium salt of isoascorbic acid (an erythorbate). This portion of the combination is used to the extent of from about 0.10 to about 1.0 equivalent per equivalent of the nitrite in the grease composition, preferably from about 0.5 to about 0.75 equivalent per equivalent.

The second member of the mixture is alpha tocopherol, the formula of which is found in Merck Index, 9th. Edition (compound 9681). This may be used so that the concentration, relative to the nitrite present, is within the same range as stated for the ascorbate or isoascorbate.

These two inhibitors may be individually added to the grease formulation so that their respective concentrations are as stated hereinabove. Or they may be combined, in any convenient concentrations, and added as the combination to the grease to give the desired amounts of each.

A wide variety of thickening agents can be used in the greases of this invention. Included among the thickening agents are alkali and alkaline earth metal soaps of fatty acids and fatty materials having from about 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprise substituted ureas, phthalocyanines, indanthrene, pigments such as perylimides, pyromellitdiimides, and ammeline.

The preferred thickening gelling agents employed in the grease compositions are essentially hydrophobic clays. Such thickening agents can be prepared from clays which are initially hydrophilic in character, but which have been converted into a hydrophobic condition by the introduction of long chain hydrocarbon radicals into the surface of the clay particles; prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3 percent to 15, percent by weight of the total grease composition.

Oils used in the greases of this invention can be mineral or synthetic oils of lubricating viscosity. Suitable mineral oils have a viscosity (SUS) of at least 40 seconds at 100° F., and particularly those within the range of about 60 seconds to about 6000 seconds at 100° F.

Synthetic vehicles can be used, instead of mineral oils, or in combination therewith. Typical synthetic vehicles are: polypropylene, polypropylene glycol, trimethylol propane esters, neopentyl and pentaerythritol esters, di(2-ethyl hexyl) sebacate, di(2-ethyl hexoate), fluorocarbons, silicate esters, silanes, esters of phosphorus-containing acids, liquid ureas, ferrocene derivatives, hydrogenated mineral oils, chain type polyphenyls, siloxanes and silicones (polysiloxanes), alkyl-substituted diphenyl ethers typified by a butyl-substituted bis-(p-phenoxy phenyl) ether, and phenoxy phenyl ethers.

Other hydrocarbon oils include synthetic hydrocarbon polymers having improved viscosity indices, which polymers are prepared by polymerizing an olefin, or mixture of olefins, having from 5 to 18 carbon atoms per molecule in the presence of an aliphatic halide and a Ziegler-type catalyst.

It is to be understood, however, that the compositions contemplated herein can also contain other characterizing materials. For examples, dispersants, corrosion inhibitors, extreme pressure agents, and fillers can be used. Among such materials are colloidal silica, calcium acetate, calcium carbonate and molybdenum disulfide. Such characterizing materials do not detract from the lubricating value of the compositions of this invention. Rather, the characterizing materials serve to impart their customary properties to the particular compositions in which they are incorporated.

The greases of this invention can be prepared in accordance with conventional grease manufacturing procedures, as by any mixing technique wherein solid particles are wetted by a fluid. Typical equipment for such use includes a colloid mill, 3-roll ink mill, Manton-Gaulin homogenizer and the like.

Having described the invention in general terms, the following will provide specific illustrations. They are illustrations only and are not intended to limit the invention.

EXAMPLE

Samples of grease (from a synthetic hydrocarbon comprising a hydrogenated decene trimer and a non-soap grease forming agent and having an ASTM drop point of 500° F.) are compounded to contain 1.0% of phenyl-alpha-naphthylamine, 1% of sodium nitrite, both by weight of the grease and amounts of sodium ascorbate and alpha tocopherol equivalent to the nitrite present. Other grease samples are not compounded. These are used as check samples.

EVALUATION OF THE GREASES

It is shown by standard methods for determining nitrosamines that these build to an unacceptable level in greases containing none of the additives of the invention. However, those with the additive combination are shown to experience no buildup of nitrosamines in a precompounded grease, or no further buildup in a grease initially containing nitrite and amine but no additive of this invention.

We claim:

1. A lubricating grease formulation comprising a lubricating vehicle, thickener, sodium nitrite, an amine and an amount of a combination of (1) metal ascorbate or metal isoascorbate with (2) an alpha tocopherol sufficient to inhibit the formation of N-nitrosamines.

2. The grease of claim 1 wherein the metal is from group IA or Group IIA of the Periodic Table.

3. The grease of claim 2 wherein the metal is from group IA.

4. The grease of claim 3 wherein the metal is soidum.

5. The grease of claim 1 wherein the amine has the formula $$R—Ar—NH—Ar'$$

wherein R is $C_1$–$C_{10}$ hydrocarbyl group and Ar and Ar' are aromatic groups containing from 6 to 14 carbon atoms.

6. The grease of claim 5 containing about 0.5 to about 3.0% by weight of the amine.

7. The grease of claim 6 containing about 0.5 to about 3.0% by weight of sodium nitrite.

8. The grease of claim 7 containing from about 0.1 to about 1.0 equivalent of sodium ascorbate and alpha tocopherol per equivalent of sodium nitrite.

9. The grease of claim 7 containing from about 0.1 to about 1.0 equivalent of sodium isoascorbate and alpha tocopherol per equivalent of sodium nitrite.

10. The grease of claim 1 wherein the lubricating vehicle is a mineral oil.

11. The grease of claim 1 wherein the lubricating vehicle is a synthetic hydrocarbon oil.

* * * * *